US011437206B2

(12) United States Patent
Huang

(10) Patent No.: US 11,437,206 B2
(45) Date of Patent: Sep. 6, 2022

(54) WATERPROOF PRESSING STRUCTURE AND MEMBRANE SWITCH CIRCUIT BOARD USING THE SAME

(71) Applicants: LITE-ON ElECTRONICS (GUANGZHOU) LIMITED, Guangzhou (CN); LITE-ON TECHNOLOGY CORPORATION, Taipei (TW)

(72) Inventor: Jen-Chieh Huang, Taipei (TW)

(73) Assignees: LITE-ON ELECTRONICS (GUANGZHOU) LIMITED; LITE-ON TECHNOLOGY CORPORATION

( * ) Notice: Subject to any disclaimer, the term of this patent is extended or adjusted under 35 U.S.C. 154(b) by 0 days.

(21) Appl. No.: 17/154,866

(22) Filed: Jan. 21, 2021

(65) Prior Publication Data

US 2021/0350986 A1 Nov. 11, 2021

Related U.S. Application Data

(60) Provisional application No. 63/021,174, filed on May 7, 2020.

(30) Foreign Application Priority Data

Dec. 22, 2020 (CN) ..... 202011530634.X

(51) Int. Cl.
*H01H 13/06* (2006.01)
*H01H 13/14* (2006.01)
(Continued)

(52) U.S. Cl.
CPC ..... *H01H 13/06* (2013.01); *H01H 13/14* (2013.01); *H05B 45/20* (2020.01); *H05B 45/46* (2020.01); *H01H 13/83* (2013.01)

(58) Field of Classification Search
CPC .. H01H 13/702; H01H 13/703; H01H 13/704; H01H 13/705; H01H 1/02;
(Continued)

(56) References Cited

U.S. PATENT DOCUMENTS 8,779,308 B2 * 7/2014 Takemae ..... H01H 13/702 200/5 A
8,810,438 B2 * 8/2014 Tsai ..... H01H 13/83 341/22

FOREIGN PATENT DOCUMENTS

CN 103794396 A 5/2014
CN 205004232 U 1/2016
CN 106847592 A 6/2017

* cited by examiner

*Primary Examiner* — Lheiren Mae A Caroc
(74) *Attorney, Agent, or Firm* — Innovation Counsel LLP

(57) ABSTRACT

A waterproof pressing structure including a first membrane, at least one first contact, a second membrane, at least one second contact, an insulation layer and a hydrophobic material is provided. The first contact is located on the first membrane, the second contact is located on the second membrane, and the insulation layer is interposed between the first membrane and the second membrane, wherein the first membrane, the second membrane and the insulation layer are stacked in a vertical direction, and the hydrophobic material is respectively formed on the two surfaces of the first contact and the second contact to form a low surface tension zone between the first contact and the second contact.

20 Claims, 3 Drawing Sheets

(51) Int. Cl.

| | |
|---|---|
| ***H05B 45/20*** | (2020.01) |
| ***H05B 45/46*** | (2020.01) |
| *H01H 13/83* | (2006.01) |

(58) Field of Classification Search
CPC ..... H01H 1/12; H01H 13/06; H01H 13/14;
H01H 13/83; H05B 45/20; H05B 45/46
See application file for complete search history.

WATERPROOF PRESSING STRUCTURE AND MEMBRANE SWITCH CIRCUIT BOARD USING THE SAME

This application claims the benefits of U.S. provisional application Ser. No. 63/021,174, filed May 7, 2020 and People's Republic of China application Serial No. 202011530634.X, filed Dec. 22, 2020, the subject matters of which are incorporated herein by references.

BACKGROUND OF THE INVENTION

Field of the Invention

The invention relates in general to a waterproof pressing structure and a membrane switch circuit board using the same.

Description of the Related Art

According to the current design, each keyboard includes a cap, a connecting member, an elastic member and a membrane switch circuit board. The elastic member is disposed under the cap to provide the cap with an elastic restoring force. The connecting member is used to support the cap, such that when the cap is pressed, the connecting member can press the elastic member and transfer a downward pressure to the membrane switch circuit board to activate a switch element on the membrane switch circuit board.

However, water may easily enter the keyboard via the gap between two caps. When no waterproof protection or treatment is provided for the keyboard, the membrane switch circuit board may easily break down or malfunction. These problems need to be resolved.

SUMMARY OF THE INVENTION

The invention is directed to a waterproof pressing structure and a membrane switch circuit board using the same used in a waterproof keyboard or a portable computer, such that water can hardly be attached on the circuit board and the waterproof performance can be improved.

According to one embodiment of the present invention, a waterproof pressing structure including a first membrane, at least one first contact, a second membrane, at least one second contact, an insulation layer and a hydrophobic material is provided. The first contact is located on the first membrane, the second contact is located on the second membrane, and the insulation layer is interposed between the first membrane and the second membrane, wherein the first membrane, the second membrane and the insulation layer are stacked in a vertical direction, and the hydrophobic material is respectively formed on the two surfaces of the first contact and the second contact to form a low surface tension zone between the first contact and the second contact.

According to another embodiment of the present invention, a waterproof pressing structure including a first membrane, at least one first contact, a second membrane, at least one second contact, an insulation layer and a hydrophobic material is provided. The first contact is located on the first membrane, the second contact is located on the second membrane, and the insulation layer is interposed between the first membrane and the second membrane, wherein the first membrane, the second membrane and the insulation layer are stacked in a vertical direction, and the hydrophobic material is respectively formed in the first contact and the second contact to form a low surface tension zone between the first contact and the second contact.

According to an alternate embodiment of the present invention, a membrane switch circuit board including a first membrane, a first wiring layer has at least one first contact, a second membrane, a second wiring layer has at least one second contact, an insulation layer and a hydrophobic material is provided. The first contact is located on the first membrane, the second contact is located on the second membrane, and the insulation layer is interposed between the first membrane and the second membrane, wherein the first membrane, the second membrane and the insulation layer are stacked in a vertical direction, and the hydrophobic material is respectively formed on the two surfaces of the first contact and the second contact or formed in the first contact and the second contact to form a low surface tension zone between the first contact and the second contact.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the structures and operations of the invention are disclosed below with accompanying drawings.

Figure 1:
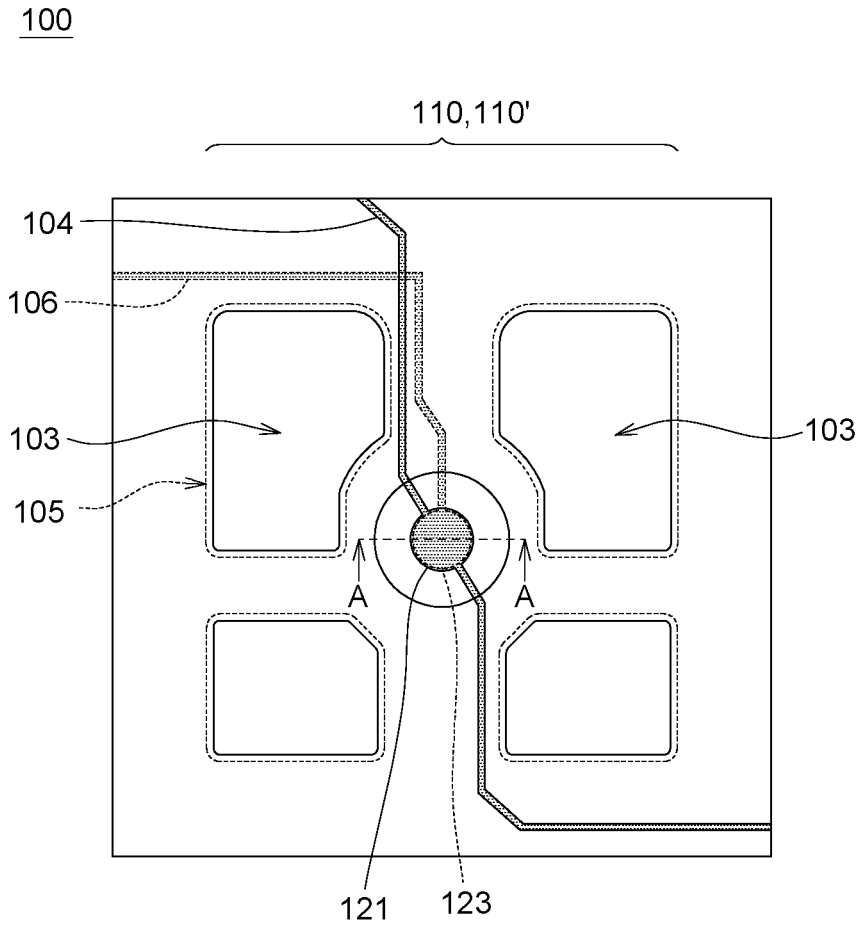
FIG. 1 is a schematic diagram of a pressing unit of a membrane switch circuit board according to an embodiment of the invention.
Figure 2:
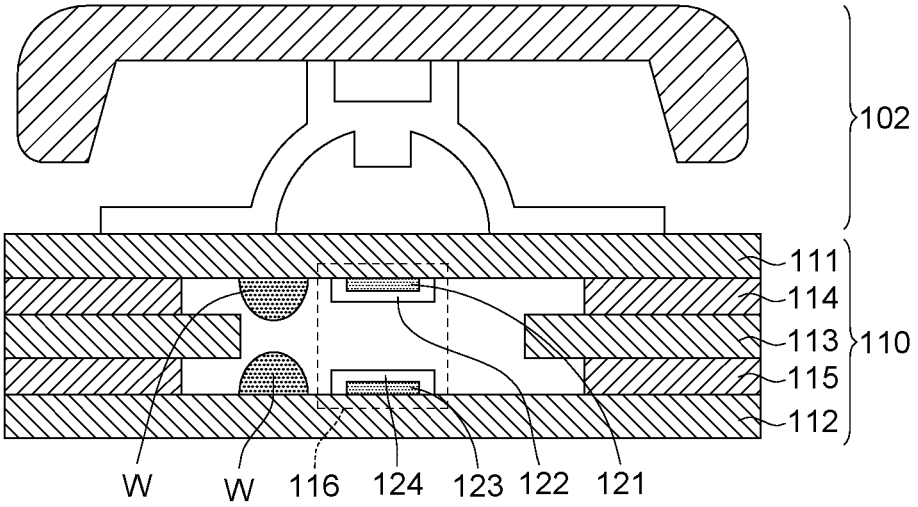
FIG. 2 is a cross-sectional view of a waterproof pressing structure according to an embodiment of the invention.
Figure 3:
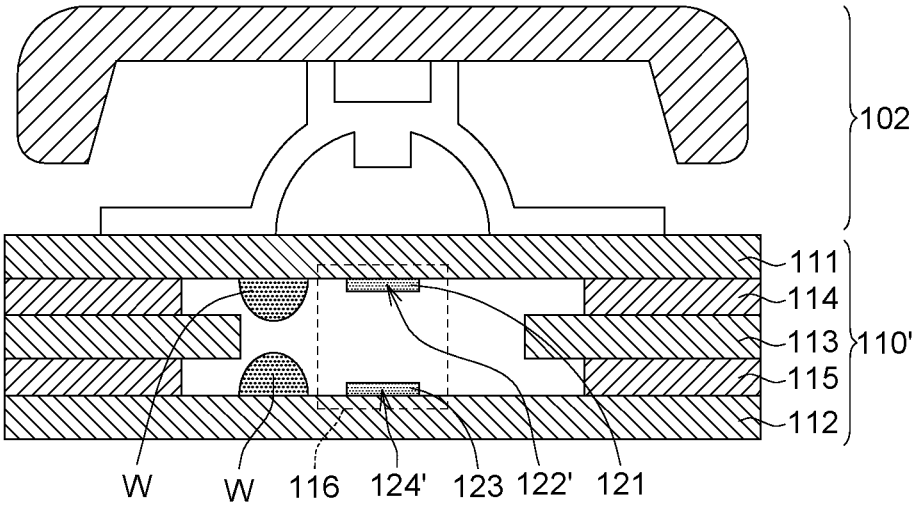
FIG. 3 is a cross-sectional view of a waterproof pressing structure according to another embodiment of the invention.

Refer to FIG. 1, FIG. 2 and FIG. 3. FIG. 1 is a schematic diagram of a pressing unit of a membrane switch circuit board 100 according to an embodiment of the invention. FIG. 2 is a cross-sectional view of a waterproof pressing structure 110 of the pressing unit according to an embodiment of the invention. FIG. 3 is a cross-sectional view of a waterproof pressing structure 110 according to another embodiment of the invention.

As indicated in FIG. 1, the membrane switch circuit board 100 is used in a keyboard structure or a portable computer to receive a pressing signal from a user and further transmit the pressing signal to a processor, and then the processor performs a corresponding command or function. The keyboard structure may include multiple keys 102 (only one is illustrated in FIG. 2). The keys 102 can be letter keys, number keys, symbol keys, function keys or keys with an indicator. The keyboard structure can be a wireless keyboard, a gaming keyboard, a backlight keyboard, a touch keyboard, an ultra-thin and flat keyboard or an optical axis keyboard, and the invention does not have specific restrictions regarding the said exemplification.

As indicated in FIG. 1, the membrane switch circuit board 100 has at least one waterproof pressing structure 110 and multiple opening portions 103, wherein the waterproof pressing structure 110 is correspondingly disposed under each of the keys 102 (as indicated in FIG. 2 and FIG. 3) to form a waterproof switch. The opening portions 103 are disposed in the surrounding area of the waterproof pressing structure 110, wherein each of the keys 102 and the pivot hooks of a bottom plate (not illustrated in the diagram) disposed under the keys 102 are connected through the opening portions 103. To avoid water entering the waterproof pressing structure 110 via the opening portions 103, in an embodiment, the surrounding area of the opening portions 103 is processed with a waterproof treatment (such as soaking the hydrophobic liquid 105 as indicated in dotted lines), such that the water cannot be attached on the opening portions 103. When water enters the keyboard, the water can only be attached on the membrane or the bottom plate having a strong adhesion for water, but not the surrounding area of the opening portions 103 which has been processed with a hydrophobic treatment and therefore has a weaker adhesion for water. Thus, the waterproof and hydrophobic functions can be achieved.

As indicated in FIG. 1, the membrane switch circuit board 100 further includes a first wiring layer 104 and a second wiring layer 106, respectively located on two membranes, wherein the first wiring layer 104 is electrically connected to the first contact 121 of the waterproof pressing structure 110, and the second wiring layer 106 is electrically connected to the second contact 123 of the waterproof pressing structure 110, and the first wiring layer 104 and the second wiring layer 106 can be formed of copper, silver or other conductive materials. The user can press the waterproof pressing structure 110 to generate a pressing signal and conduct the first wiring layer 104 and the second wiring layer 106 to transmit the pressing signal to the processor, and then the processor performs a corresponding command or function. Detailed descriptions of the structures and a cross-sectional view along a cross sectional line A-A of the waterproof pressing structures 110 and 110' can be obtained with reference to FIG. 2 and FIG. 3.

Refer to FIG. 2. The waterproof pressing structure 110 includes a first membrane 111, at least one first contact 121, a second membrane 112, at least one second contact 123, an insulation layer 113 and hydrophobic materials 122 and 124. The first contact 121 is located on the first membrane 111, the second contact 123 is located on the second membrane 112, the insulation layer 113 is interposed between the first membrane 111 and the second membrane 112, wherein the first membrane 111, the second membrane 112 and the insulation layer 113 are stacked in a vertical direction, and the hydrophobic materials 122 and 124 are respectively formed on the two surfaces of the first contact 121 and the second contact 123 to form a low surface tension zone 116 between the first contact 121 and the second contact 123.

Besides, the waterproof pressing structure 110 may include a first adhesive layer 114 and a second adhesive layer 115, wherein the first adhesive layer 114, such as a waterproof adhesive, is interposed between the first membrane 111 and the insulation layer 113, and the second adhesive layer 115, such as a waterproof adhesive, is interposed between the second membrane 112 and the insulation layer 113. The first contact 121 and the second contact 123 form a pressing contact area defined by an area surrounded by the first membrane 111, the second membrane 112 and the insulation layer 113, such that the first contact 121 and the second contact 123 keep a predetermined gap in a normal status (the first contact 121 and the second contact 123 contact each other only when pressed but do not contact each other in the normal status).

In an embodiment, the hydrophobic materials 122 and 124 can be selected from organo-fluoro compound, organo-silicone compound, fluoro-silicone, and perfluoro-polyether or hydrophobic silanes, wherein hydrophobic silanes may contain methyl, straight chain alkyl, branched alkyl, fluoro-alkyl, aryl or bipedal group.

The hydrophobic materials 122 and 124 can be respectively formed on the two surfaces of the first contact 121 and the second contact 123 by way of coating or jet printing, such that the water can hardly be attached on the first contact 121 and the second contact 123. Refer to FIG. 2. Specifically, when water W accidentally enter the waterproof pressing structure 110, the water W can only be attached on the inner-wall of the first membrane 111 or the second membrane 112 having stronger adhesion for water and can hardly be attached on the two surfaces of the first contact 121 and the second contact 123 which are coated with the hydrophobic materials 122 and 124 and have weaker adhesion for water. Thus, the waterproof and hydrophobic functions can be achieved. Meanwhile, when water W accidentally enter the waterproof pressing structure 110, due to the hydrophobic materials 122 and 124, the water W can hardly stay in the pressing contact area between the first contact 121 and the second contact 123 (spaced by a predetermined gap), and a low surface tension zone 116 (weak adhesion area) can be formed between the first contact 121 and the second contact 123. Thus, the first contact 121 and the second contact 123 will not be short-circuited by water W to prevent a malfunction from the waterproof pressing structure 110.

In another embodiment as indicated in FIG. 3, the waterproof pressing structure 110' includes a first membrane 111, at least one first contact 121, a second membrane 112, at least one second contact 123, an insulation layer 113 and hydrophobic materials 122' and 124'. The first contact 121 is located on the first membrane 111, the second contact 123 is located on the second membrane 112, and the insulation layer 113 is interposed between the first membrane 111 and the second membrane 112, wherein the first membrane 111, the second membrane 112 and the insulation layer 113 are stacked in a vertical direction, and the hydrophobic materials 122' and 124' are respectively formed in the first contact 121 and the second contact 123 to form a low surface tension zone 116 between the first contact 121 and the second contact 123.

As indicated in FIG. 3, the function and the material of the hydrophobic materials 122' and 124' are similar or identical to that of the hydrophobic materials 122 and 124 of FIG. 2, such that the water W can hardly be attached on the two surfaces of the first contact 121 and the second contact 123, which are hydrophobic and have weaker adhesion for water and will not be short-circuited by water W to prevent a malfunction from the waterproof pressing structure 110.

Figure 4:
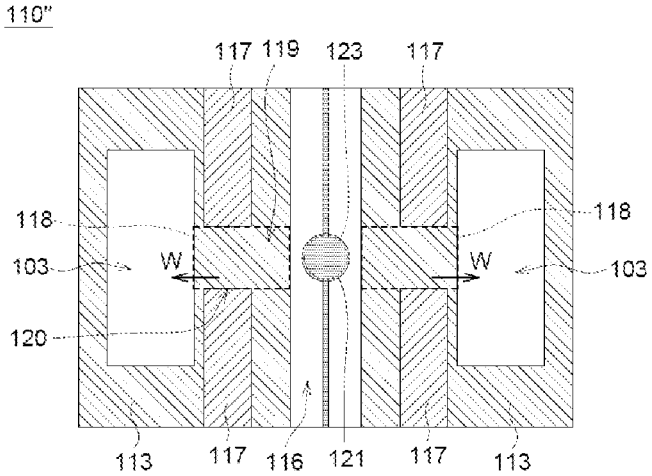
FIG. 4 is a schematic diagram of a waterproof pressing structure according to another embodiment of the invention.

Referring to FIG. 4, a schematic diagram of a waterproof pressing structure 110" according to another embodiment of the invention is sown. In the present embodiment, multiple opening portions 103 are disposed in the surrounding area of the waterproof pressing structure 110", and the insulation layer 113 of the waterproof pressing structure 110" has a hydrophilic coating 119 formed in the surrounding area of the first contact 121 and the second contact 123 to form a high surface tension zone 118 in the surrounding area of the low surface tension zone 116, wherein the surrounding area of the first contact 121 and the second contact 123 is coated with the hydrophobic material or contains the hydrophobic material. The low surface tension zone 116 has higher hydrophobicity than the high surface tension zone 118.

Moreover, an adhesive layer 117 can be formed on the insulation layer 113, and the function of the adhesive layer 117 is identical to the first adhesive layer 114 and the second adhesive layer 115 of FIG. 2 and FIG. 3. The adhesive layer 117 has a vent hole 120 formed between the low surface tension zone 116 of the waterproof pressing structure 110" and the opening portions 103, respectively. When the waterproof pressing structure 110" is pressed, the air is vented off the opening portions 103 via the vent hole 120.

In an embodiment, the hydrophilic coating 119 in the vent hole 120 can be a material selected from hydrophilic silanes, polyvinyl alcohol or polyacrylic acid, wherein hydrophilic silanes may contain polar group or hydroxyl. The hydrophilic coating can be formed on the surface of the insulation layer 113 by way of coating or jet printing, such that the water can be easily attached on the insulation layer 113. When water W accidentally enter the waterproof pressing structure 110, due to the hydrophilic coating 119, the water W can more easily move to the high surface tension zone 118 from the low surface tension zone 116 (the direction is indicated by arrows), such that the water W can be more easily vented off the opening portions 103 via the vent hole 120, and the waterproof, hydrophobic and water-guiding functions can be achieved.

The surface tension of the high surface tension zone 118 is higher than 30 Dyne/cm, such as between 30 and 40 Dyne/cm or even higher; the surface tension of the low surface tension zone 116 is lower than 25 Dyne/cm, such as between 25 and 18 Dyne/cm or even lower. The adhesion of the high surface tension zone 118 for water is stronger than the adhesion of the low surface tension zone 116 for water. In the present embodiment, the low surface tension zone 116 and the high surface tension zone 118 are formed using the hydrophobic material and the hydrophilic coating 119, such that the water W can be quickly vented to the opening portions 103. In another embodiment, only the low surface tension zone 116 is disposed, and the water W can be vented to the opening portions 103 via the vent hole 120.

Apart from forming on the surface of the insulation layer 113 of FIG. 4, the hydrophilic coating 119 can also be formed on the inner-wall of the first membrane 111 and the second membrane 112 of FIG. 2 and FIG. 3, such that the water W can be easily attached on the first membrane 111 and the second membrane 112. Due to the hydrophilic coating 119, the water W can more easily move to the high surface tension zone 118 from the low surface tension zone 116 to be vented to the opening portions 103 of FIG. 1.

That is, the hydrophilic coating 119 is formed in the surrounding area of the first contact 121 and the second contact 123 coated with the hydrophobic material or contains the hydrophobic material of FIG. 2 to form a high surface tension zone 118 in the surrounding area of the low surface tension zone 116.

The waterproof pressing structure and the membrane switch circuit board using the same disclosed in the embodiments of the invention are used in a waterproof keyboard or a portable computer, such that the water can hardly be attached on the circuit board and the waterproof performance can be improved.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A waterproof pressing structure, comprising:
- a first membrane;
- at least one first contact located on the first membrane;
- a second membrane;
- at least one second contact located on the second membrane;
- an insulation layer interposed between the first membrane and the second membrane, wherein the first membrane, the second membrane and the insulation layer are stacked in a vertical direction; and
- a hydrophobic material respectively formed on two surfaces of the first contact and the second contact to form a low surface tension zone between the first contact and the second contact.

2. The waterproof pressing structure according to claim 1, wherein the first contact and the second contact are spaced by an interval and form a pressing contact area defined by an area surrounded by the first membrane, the second membrane and the insulation layer.

3. The waterproof pressing structure according to claim 1, further comprising a first adhesive layer and a second adhesive layer, wherein the first adhesive layer is interposed between the first membrane and the insulation layer, and the second adhesive layer is interposed between the second membrane and the insulation layer.

4. The waterproof pressing structure according to claim 3, wherein a plurality of opening portions are disposed in a surrounding area of the waterproof pressing structure, and the first adhesive layer or the second adhesive layer has a vent hole formed between the waterproof pressing structure and the opening portions, respectively.

5. The waterproof pressing structure according to claim 1, wherein the insulation layer has a hydrophilic coating formed in a surrounding area of the first contact and the second contact coated with the hydrophobic material to form a high surface tension zone.

6. The waterproof pressing structure according to claim 5, wherein an adhesion of water on the high surface tension zone is stronger than the adhesion of water on the low surface tension zone.

7. The waterproof pressing structure according to claim 5, wherein the hydrophilic coating is a material selected from hydrophilic silanes, polyvinyl alcohol and polyacrylic acid.

8. The waterproof pressing structure according to claim 1, wherein the hydrophobic material is a material selected from organo-fluoro compound, organo-silicone compound, fluoro-silicone, perfluoro-polyether or hydrophobic silanes.

9. A waterproof pressing structure, comprising:
- a first membrane;
- at least one first contact located on the first membrane;
- a second membrane;
- at least one second contact located on the second membrane;
- an insulation layer interposed between the first membrane and the second membrane, wherein the first membrane, the second membrane and the insulation layer are stacked in a vertical direction; and
- a hydrophobic material respectively formed in the first contact and the second contact to form a low surface tension zone between the first contact and the second contact.

10. The waterproof pressing structure according to claim 9, wherein the first contact and the second contact are spaced by an interval and form a pressing contact area defined by an area surrounded by the first membrane, the second membrane and the insulation layer.

11. The waterproof pressing structure according to claim 9, further comprising a first adhesive layer and a second adhesive layer, wherein the first adhesive layer is interposed between the first membrane and the insulation layer, and the second adhesive layer is interposed between the second membrane and the insulation layer.

12. The waterproof pressing structure according to claim 11, wherein a plurality of opening portions are disposed in a surrounding area of the waterproof pressing structure, and the first adhesive layer or the second adhesive layer has a vent hole formed between the low surface tension zone of the waterproof pressing structure and the opening portions, respectively.

13. The waterproof pressing structure according to claim 9, wherein the insulation layer has a hydrophilic coating formed in a surrounding area of the first contact and the second contact containing the hydrophobic material to form a high surface tension zone.

14. The waterproof pressing structure according to claim 13, wherein an adhesion of water on the high surface tension zone is stronger than the adhesion of water on the low surface tension zone.

15. The waterproof pressing structure according to claim 13, wherein the hydrophilic coating is a material selected from one of hydrophilic silanes, polyvinyl alcohol and polyacrylic acid.

16. The waterproof pressing structure according to claim 9, wherein the hydrophobic material is a material selected from one of organo-fluoro compound, organo-silicone compound, fluoro-silicone, perfluoropolyether and hydrophobic silanes.

17. A membrane switch circuit board, comprising:

a first membrane;

a first wiring layer having at least one first contact located on the first membrane;

a second membrane;

a second wiring layer having at least one second contact located on the second membrane;

an insulation layer interposed between the first membrane and the second membrane, wherein the first membrane, the second membrane and the insulation layer are stacked in a vertical direction; and a hydrophobic material respectively formed on two surfaces of the first contact and the second contact or formed in the first contact and the second contact to form a low surface tension zone between the first contact and the second contact.

18. The membrane switch circuit board according to claim 17, wherein the insulation layer has a hydrophilic coating formed in a surrounding area of the first contact and the second contact coated with or contains the hydrophobic material to form a high surface tension zone.

19. The membrane switch circuit board according to claim 18, wherein the hydrophilic coating is a material selected from one of hydrophilic silanes, polyvinyl alcohol or polyacrylic acid.

20. The membrane switch circuit board according to claim 17, wherein the hydrophobic material is a material selected from one of organo-fluoro compound, organo-silicone compound, fluoro-silicone, perfluoropolyether and hydrophobic silanes.

* * * * *